United States Patent [19]

Schultz

[11] Patent Number: 4,670,030

[45] Date of Patent: Jun. 2, 1987

[54] VACUUM CLEANER FILTER

[76] Inventor: Steven Schultz, 510 Avenue B, Del Rio, Tex. 78840

[21] Appl. No.: 866,447

[22] Filed: May 23, 1986

[51] Int. Cl.[4] ..... B01D 46/02

[52] U.S. Cl. ..... 55/370; 55/380; 55/DIG. 2

[58] Field of Search ..... 55/369–371, 55/375–378, 380–382, DIG. 2

[56] References Cited

U.S. PATENT DOCUMENTS

| | | | |
|---|---|---|---|
| 1,914,370 | 6/1933 | Hutchison | 55/369 X |
| 4,084,948 | 4/1978 | MacFarland | 55/371 X |
| 4,116,648 | 9/1978 | Busch | 55/369 X |

*Primary Examiner*—Charles Hart

[57] ABSTRACT

A double walled vacuum cleaner filter having a reusable inner bag with a zippered opening for debris removal.

4 Claims, 3 Drawing Figures

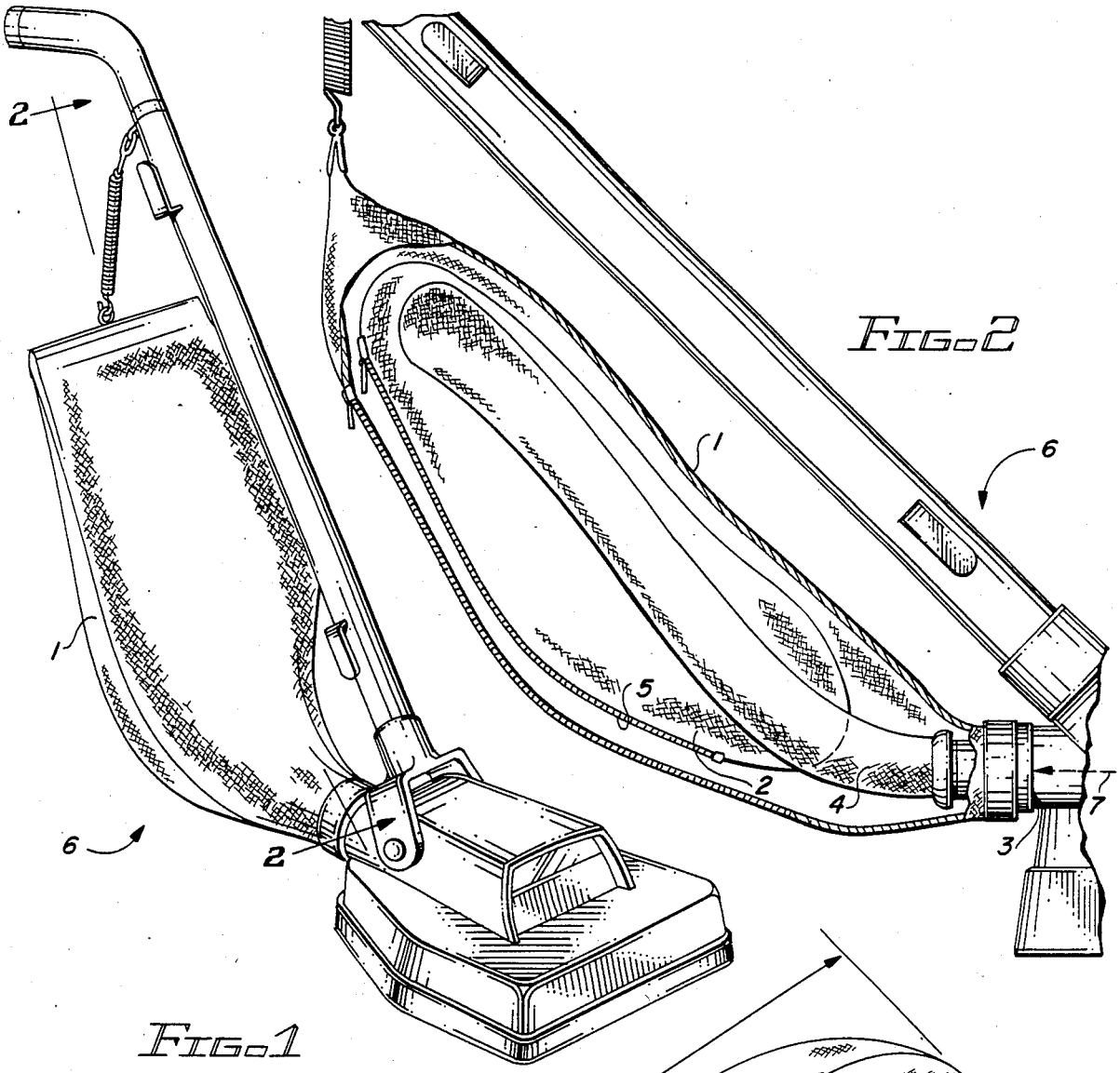
FIG. 2
FIG. 1
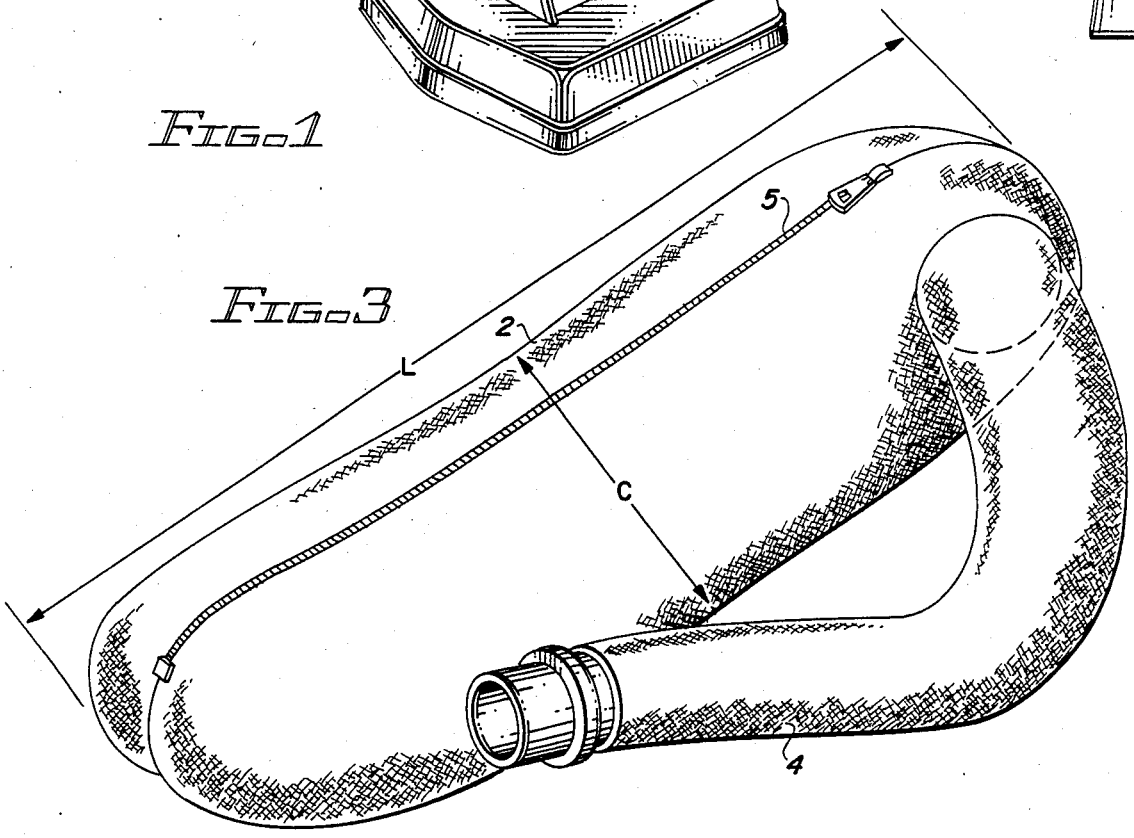
FIG. 3

VACUUM CLEANER FILTER

BACKGROUND

This invention relates to the collecting bag which removes dust and debris from a moving stream of air of a vacuum cleaner, especially multi-layered bags for upright vacuum cleaners.

In common vacuum cleaner systems the discharge stream of a motor driven fan is directed through a permeable filter to obstruct passage of and collect dust. A variety of filter designs are common. A first type, a single walled bag, catches the dust and must be routinely cleaned. A second variety has a double walled filter being an outer bag containing an inner, disposable bag. A double walled bag is considered advantageous over a single walled bag because part of the resistance to air flow, or back pressure on the fan, is spacially separated from the filtration activity. The inner bag serves as collector of the dust.

It is desired to provide for an improved collecting bag which combines the advantage of a double wall with the convenience of a single wall bag.

SUMMARY

A vacuum cleaner filter having an outer bag for imposition of air flow back pressure and an inner bag for dust collection, the inner bag having a zippered opening to enable convenient removal of dust and debris, the entire filter being consequently reuseable.

BRIEF DESCRIPTION OF THE DRAWINGS

FIG. 1 is a schematic of an upright vacuum cleaner;
FIG. 2 is a section from FIG. 1; and
FIG. 3 is a schematic of the inner bag.

DETAILED DESCRIPTION

The conventional features of a double walled filter for a vacuum cleaner are described in U.S. Pat. No. 4,116,648 Sept. 26, 1978) to Busch, incorporated herein by reference. The inner bag 20 serves as a disposable filter and is located within an outer bag 22.

The outer bag exerts a back pressure on the fan and slows the air flow through the inner bag which serves as the filter element. The slower air flow through the filter element enhances dust retention due to reduced force-through of dust through the filter.

To understand the current invention, refer to FIG. 1 which shows the outward appearance of an upright vacuum cleaner 6 having a visible, elongated, outer bag 1. In FIG. 2, the elongated, inner bag 2 can be seen inside outer bag 1. Inner bag 2 is attached to the air discharge outlet/fan discharge 3 by a tube 4. Arrow 7 shows the air stream direction. FIG. 3 shows inner bag 2 and an elongated opening 5 which has fastener means for closing and opening opening 5. When inner bag 2 is removed from outer bag 1, it is convenient to open opening 5 and remove and discard dust and debris trapped inside, enabling reuse of inner bag 2, and outer bag 1, thus the entire vacuum cleaner filter composed of those members in combination.

Opening 5 is shown disposed along the length L of inner bag 2 but can also be along circumference C. Opening 5 may be closeable by a zipper, as shown in FIG. 3.

It is intended that opening 5 be of length or size appropriate to extend substantially the length or circumference of inner bag 2 to enable easy removal of debris. The opening should be as large as possible.

A wide variety of zippers are conventional and well known, and may be of a metallic or plastic composition. The construction details of the zipper form no part of the invention. The materials used to fabricate the inner and outer bags are also conventional.

The use of a zippered inner bag is not restricted to an upright vacuum cleaner but is also applicable to canister or other designs.

The invented filter is considered to have the convenience of a single bag in that it may be cleaned and need not be supplied with replacement disposable filter bags, and yet preserves the advantage of double wall filter which relates to a separation of dust retention and flow reduction functions.

I claim:

1. In a vacuum cleaner filter for a vacuum cleaner apparatus having a motor, fan, an air discharge outlet and a double walled filter composed of an elongated outer bag and an elongated inner bag connected to the air discharge outlet to filter and collect dust from an air stream therefrom, the improvement comprising said elongated inner bag defining an elongated opening disposed along the longitudinal axis of said inner bag and fastener means for selectively opening and closing of the elongated opening of said inner bag, said elongated opening extending a substantial portion of the inner bag longitudinal axis thereby enabling convenient removal of dust and debris therein therefrom, said filter being consequently reusable.

2. In a vacuum cleaner filter for a vacuum cleaner apparatus having a motor, fan, an air discharge outlet and a double walled filter composed of an elongated outer bag and an elongated inner bag connected to the air discharge outlet to filter and collect dust from an air stream therefrom, the improvement comprising said elongated inner bag defining an elongated opening disposed along the circumferential axis of said inner bag and fastener means for selectively opening and closing of the elongated opening of said inner bag, said elongated opening extending a substantial portion of the inner bag circumferential axis thereby enabling convenient removal of dust and debris therein therefrom, said filter being consequently reusable.

3. The filter of claim 1 wherein said fastener means is a zipper.

4. The filter of claim 2 wherein said fastener means is a zipper.

* * * * *